US006409916B1

(12) United States Patent
Zelas et al.

(10) Patent No.: US 6,409,916 B1
(45) Date of Patent: Jun. 25, 2002

(54) FILTER ELEMENT FOR POOL-CLEANING DEVICE

(75) Inventors: Shimon Zelas, Kibbutz Yizreel; Freddy Derfler, Kiryat Ata, both of (IL)

(73) Assignee: Maytronics, Ltd., Kibbutz Yizrell (IL)

( * ) Notice: Subject to any disclaimer, the term of this patent is extended or adjusted under 35 U.S.C. 154(b) by 0 days.

(21) Appl. No.: 09/631,520

(22) Filed: Aug. 3, 2000

(30) Foreign Application Priority Data

Aug. 3, 1999 (IL) ..... 131222

(51) Int. Cl.[7] ..... E04H 3/16

(52) U.S. Cl. ..... 210/169; 210/416.2; 210/438; 210/452; 15/1.7

(58) Field of Search ..... 210/169, 416.2, 210/438, 452, 478, 495; 15/1.7

(56) References Cited

U.S. PATENT DOCUMENTS 389,790 A * 9/1888 Boutell ..... 210/478
1,639,170 A * 8/1927 Fell ..... 210/452
3,347,386 A * 10/1967 Kraissl, Jr. ..... 210/452
3,439,368 A * 4/1969 Myers ..... 15/1.7
4,154,680 A * 5/1979 Sommer ..... 15/1.7
5,645,721 A * 7/1997 Curroll, Jr. ..... 210/438
5,830,350 A * 11/1998 Voss et al. ..... 210/169
5,842,243 A * 12/1998 Horvath et al. ..... 15/1.7

* cited by examiner

*Primary Examiner*—Christopher Upton
(74) *Attorney, Agent, or Firm*—Lackenbach Siegel; J. Harold Nissen

(57) ABSTRACT

The invention provides, in combination with a swimming pool cleaning device comprising an outer shell with a detachable lid, the outer shell being open at its lower end, and an inner shell spaced apart therefrom, open at its upper end and accommodating an impeller and a clean-water exit tube, the improvement comprising a filter element having a basket-like shape including a tubular central stem configured to be seated on the exit tube, the central stem being surrounded by an annular trough constituting the active filtering portion of the element, with the outer rim of the trough being detachably affixed to the inner shell, wherein, during operation of the device, solids-entraining water drawn by the impeller enters the annular trough from above and, passing the active filtering portion, emerges therefrom as clean water to be expelled through the exit tube and returned to the pool.

10 Claims, 2 Drawing Sheets

FILTER ELEMENT FOR POOL-CLEANING DEVICE

FIELD OF THE INVENTION

The present invention relates to a filter element for devices for cleaning the floors of swimming pools or other water-covered surfaces.

BACKGROUND OF THE INVENTION

Pool cleaning devices are known, e.g., from U.S. Pat. No. 4,169,557, and comprise a small, electrically driven, track vehicle equipped with rotary brushes which clean the floor, with the water containing the dirt pried loose being drawn through a filter and, thus cleaned, being returned to the pool. A serious disadvantage of this and similar devices resides in the fact that in order to clean or replace the filter element, the device, having been removed from the water, has to be turned upside down for filter removal and return. Furthermore, there is a need for non-return valves on the bottom of the device, to prevent the high concentration of dirt returning to the pool together with the still unfiltered amount of water present in the space downstream of the filter element.

DISCLOSURE OF THE INVENTION

It is thus one of the objects of the present invention to provide a filter element that can be removed from and returned to the cleaning device for cleaning or replacing, without any need to turn the device upside down.

It is a further object of the invention to provide a filter element of such configuration that the solids-entraining water reaches it from above, and that the high solids concentration inside the filter can never return to the pool, obviating the need for non-return valves.

According to the invention, the above objects are achieved by providing, in combination with a swimming pool cleaning device comprising an outer shell with a detachable lid, said outer shell being open at its lower end, and an inner shell spaced apart therefrom, open at its upper end and accommodating an impeller and a clean-water exit tube, the improvement comprising a filter element having a basket-like shape including a tubular central stem configured to be seated on said exit tube, said central stem being surrounded by an annular trough constituting the active filtering portion of said element, with the outer rim of said trough being detachably affixed to said inner shell, wherein, during operation of said device, solids-entraining water drawn by said impeller enters said annular trough from above and, passing said active filtering portion, emerges therefrom as clean water to be expelled through said exit tube and returned to said pool.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a cross-sectional view of the filter element according to the invention, and FIG. 2 is a cross-sectional view of the pool-cleaning device accommodating the filter element.

DETAILED DESCRIPTION

Figure 1:
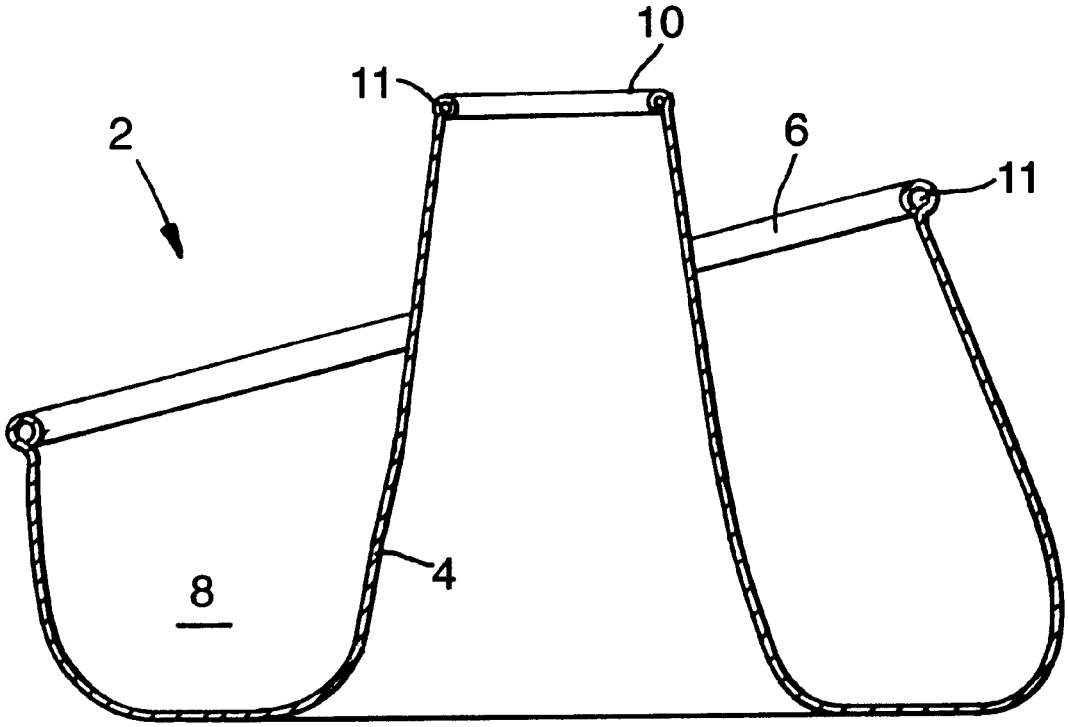

Referring now to the drawings, there is shown in FIG. 1 the filter element 2 according to the invention. Filter element 2 is seen to have a basket-like shape, including a tubular central stem 4 projecting beyond the peripheral rim 6 of an annular trough 8 that constitutes the active filtering portion of element 2. Stem 4 is provided with a similar rim 10. Both rims 6 and 10 are advantageously beaded, the beads being produced by wrapping the filter cloth around a stainless steel wire ring 11, which imparts both some stiffness and flexibility to the element. Both properties are required for the mounting and dismounting of element 2 from the interior of the cleaning device.

The asymmetrical shape of the present embodiment of element 2 is a pure design choice, dictated by aesthetic considerations related to the outer shape and appearance of the cleaning device.

Figure 2:
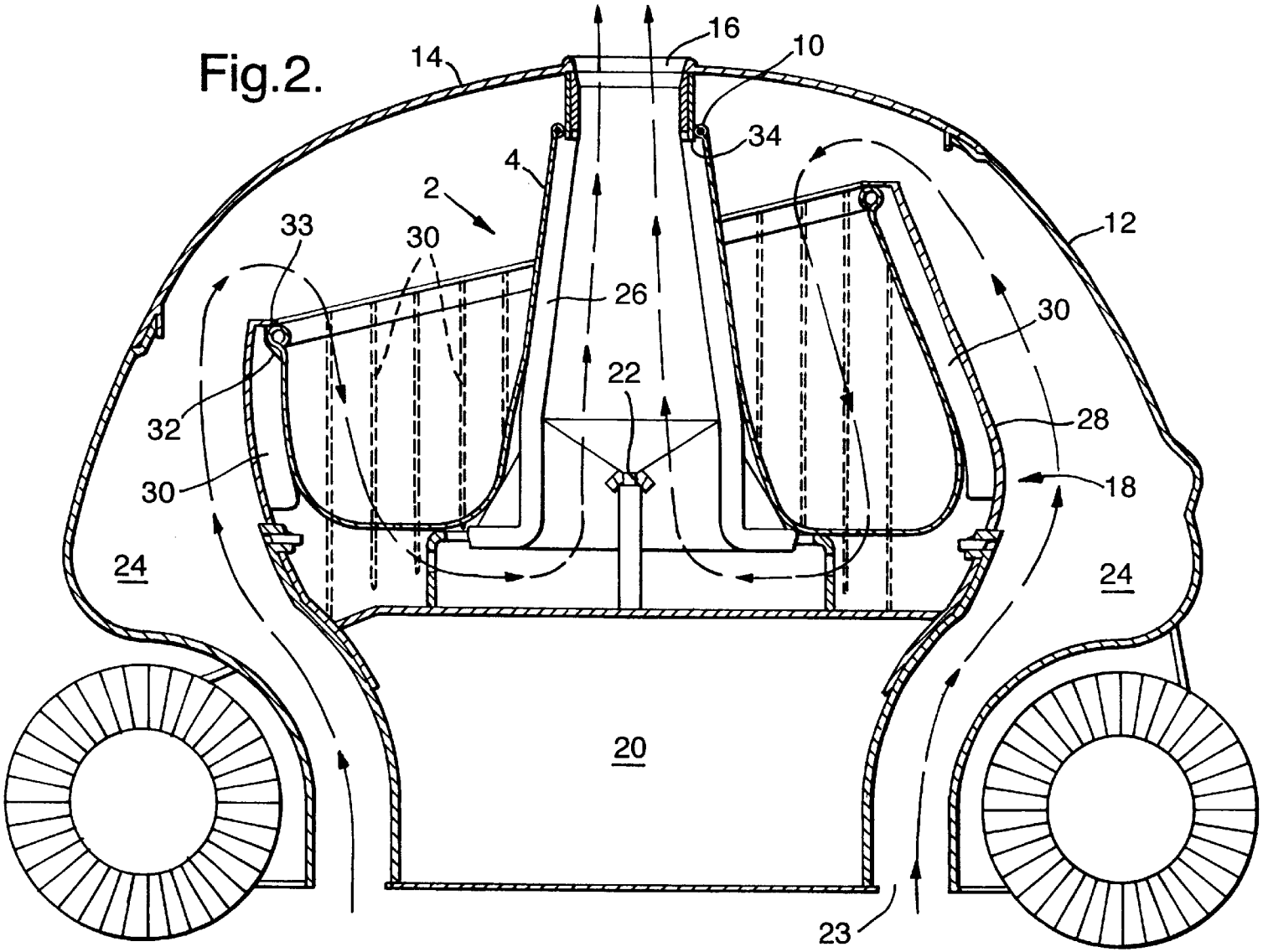

FIG. 2 is a cross-sectional view of the device. There is seen an outer shell 12 including a detachable lid 14 with an opening 16. Shell 12 is open towards the underside of the device. There is further seen an inner shell 18, closed towards the underside, but open towards the upper side. Shell 18 further comprises a space 20, hermetically sealed against the penetration of water, which accommodates an electric motor (not shown) for an impeller 22, as well as the guiding electronics. Between them, the outer shell 12 and inner shell 18 define a quasi-annular space with a large, permanently open, annular opening 23, through which the solids-laden water is drawn by impeller 22 into the active filtering portion 24 of filter element 2 (see solid dashed lines and arrows). The water leaves the filter element as cleaned water (see hollow dashed lines) to be expelled by impeller 22 through an exit tube 26, back into the pool.

Filter element 2 is seen located in the upper, bowl-shaped portion 28 of inner shell 18. The inside wall of portion 28 is provided with a plurality of vertical ribs 30, which provide lateral support for filter element 2 without interfering with the filtering action of the outside wall of annular trough 8. At their upper ends, ribs 30 are provided with recesses 32 covered by a broad flange 33. Beaded rim 6 snaps into recesses 32, thereby supporting element 2. Central stem 4 is pulled over exit tube 26, thereby conforming to the shape of the latter, its upper rim 10 being seated on a shoulder 34 provided for that purpose.

To remove filter element 2 for cleaning or replacing, lid 14 is removed and rim 6 is progressively pulled out from recesses 32. With rim 10 now being lifted off shoulder 34, the entire element 2 is easily removed for cleaning. The cleaned filter element is returned with equal ease: rim 6 is snapped into recesses 32 and central stem 4 is stretched over exit tube 26 until rim 10 is seated on shoulder 34. Lid 14 is then replaced.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In combination with a swimming pool cleaning device comprising an outer shell with a detachable lid, said outer shell being open at its lower end, and an inner shell spaced apart therefrom, open at its upper end and accommodating an impeller and a clean-water exit tube, the improvement comprising:

a filter element having a basket-like shape including a tubular central stem configured to be seated on said exit tube, said central stem being surrounded by an annular trough constituting the active filtering portion of said element, with the outer rim of said trough being detachably affixed to said inner shell, wherein, during operation of said device, solids-entraining water drawn by said impeller enters said annular trough from above and, passing said active filtering portion, emerges therefrom as clean water to be expelled through said exit tube and returned to said pool.

2. The filter element as claimed in claim 1, wherein said annular trough includes side and bottom portions;

said central stem projecting beyond the rim of said annular trough:

wherein solids-containing fluid is filtered by said active filtering portion including said bottom portion.

3. The filter element as claimed in claim 2, wherein the outer wall of said annular trough terminates in a beaded rim.

4. The filter element as claimed in claim 3, wherein said beaded rim is reinforced by elastically resilient wire means.

5. The filter element as claimed in claim 2, wherein said central stem terminates in a beaded rim.

6. The filter element as claimed in claim 5, wherein said beaded rim is reinforced by elastically resilient wire means.

7. The filter element as claimed in claim 1, wherein the outer wall of said annular trough terminates in a beaded rim.

8. The filter element as claimed in claim 7, wherein said rim is reinforced by elastically resilient wire means.

9. The filter element as claimed in claim 1, wherein said central stem terminates in a beaded rim.

10. The filter element as claimed in claim 9, wherein said beaded rim is reinforced by elastically resilient wire means.

* * * * *